US008104234B1

(12) United States Patent
Sawyer

(10) Patent No.: US 8,104,234 B1
(45) Date of Patent: Jan. 31, 2012

(54) PREFABRICATED DECORATIVE FRIEZE TRIM

(76) Inventor: Steven T. Sawyer, N. Smithfield, RI (US)

( * ) Notice: Subject to any disclaimer, the term of this patent is extended or adjusted under 35 U.S.C. 154(b) by 87 days.

(21) Appl. No.: 12/584,536

(22) Filed: Sep. 8, 2009

(51) Int. Cl.
*E04D 13/00* (2006.01)

(52) U.S. Cl. ..... 52/96; 52/309.8; 52/716.1

(58) Field of Classification Search ..... 52/94, 96, 52/309.1, 309.4, 309.5, 309.6, 309.7, 309.8, 52/309.9, 404.1, 716.1, 716.8, 717.04, 717.05
See application file for complete search history.

(56) References Cited

U.S. PATENT DOCUMENTS

| | | | | |
|---|---|---|---|---|
| 1,676,582 | A * | 7/1928 | Stuart | 52/27 |
| 4,109,428 | A * | 8/1978 | Aarons | 52/94 |
| 4,226,056 | A * | 10/1980 | Hallam | 52/11 |
| 4,608,800 | A * | 9/1986 | Fredette | 52/656.1 |
| 4,969,302 | A * | 11/1990 | Coggan et al. | 52/309.8 |
| 5,016,415 | A * | 5/1991 | Kellis | 52/522 |
| 5,090,174 | A | 2/1992 | Fragale | |
| 5,426,901 | A * | 6/1995 | Indracek | 52/288.1 |
| 5,457,923 | A * | 10/1995 | Logan et al. | 52/288.1 |
| 5,537,791 | A | 7/1996 | Champagne | |
| 5,560,158 | A * | 10/1996 | Norton | 52/95 |
| 5,598,677 | A | 2/1997 | Rehm, III | |
| 5,694,726 | A * | 12/1997 | Wu | 52/287.1 |
| 5,711,117 | A | 1/1998 | Zaccagni et al. | |
| 5,729,933 | A * | 3/1998 | Strength | 52/96 |
| 5,829,206 | A | 11/1998 | Bachman | |
| 6,026,616 | A * | 2/2000 | Gibson | 52/95 |
| 6,272,797 | B1 * | 8/2001 | Finger | 52/94 |
| 6,360,508 | B1 * | 3/2002 | Pelfrey et al. | 52/520 |
| 6,421,964 | B1 * | 7/2002 | Schiedegger et al. | 52/94 |
| 6,516,577 | B2 * | 2/2003 | Pelfrey et al. | 52/302.1 |
| 6,526,718 | B2 * | 3/2003 | Manning et al. | 52/555 |
| 6,539,675 | B1 * | 4/2003 | Gile | 52/96 |
| 6,643,990 | B2 * | 11/2003 | Jensen | 52/716.1 |
| 6,837,020 | B1 * | 1/2005 | Keddell | 52/745.2 |
| 6,988,345 | B1 * | 1/2006 | Pelfrey et al. | 52/519 |
| 7,036,282 | B1 * | 5/2006 | Keddell | 52/287.1 |
| 7,188,454 | B2 * | 3/2007 | Mowery et al. | 52/539 |
| 7,200,970 | B2 * | 4/2007 | Koenig, Jr. et al. | 52/287.1 |
| 7,318,282 | B2 * | 1/2008 | Pulte | 29/897 |
| 7,487,623 | B2 * | 2/2009 | Rodolofo et al. | 52/716.1 |
| 7,614,152 | B2 * | 11/2009 | Pulte | 29/897.3 |
| 7,654,049 | B2 * | 2/2010 | Koenig, Jr. et al. | 52/287.1 |
| 7,726,092 | B1 * | 6/2010 | Pelfrey et al. | 52/717.01 |
| 7,748,179 | B2 * | 7/2010 | Schiedegger et al. | 52/211 |
| 7,793,475 | B2 * | 9/2010 | Riggs | 52/288.1 |
| 7,997,043 | B1 * | 8/2011 | MacMillan et al. | 52/716.8 |
| 8,006,441 | B2 * | 8/2011 | Pulte | 52/95 |
| 2002/0088189 | A1 * | 7/2002 | Honda | 52/287.1 |
| 2002/0108327 | A1 * | 8/2002 | Shaw | 52/211 |
| 2002/0124485 | A1 * | 9/2002 | Pulte | 52/96 |
| 2004/0142157 | A1 * | 7/2004 | Melkonian | 428/292.1 |

(Continued)

*Primary Examiner* — William V Gilbert
*Assistant Examiner* — James Ference
(74) *Attorney, Agent, or Firm* — Richard L. Miller

(57) ABSTRACT

A prefabricated decorative frieze trim for securement to a lower surface of an eave and an exterior wall surface of a building which comprises a low gauge flexible sheet having a front face with an infinite variety of different ornamental shapes that can be formed thereon. A substrate member is applied to an internal surface of the low grade flexible sheet to provide structural rigidity thereto. A mechanism formed on the low grade flexible sheet is for securing the low grade flexible sheet to the lower surface of the eave and upper portion of the exterior wall surface of the building, whereby a free edge of a soffit component and a free edge of a wall siding can be retained thereto.

8 Claims, 4 Drawing Sheets

U.S. PATENT DOCUMENTS

2004/0211141 A1* 10/2004 Sandy ..... 52/506.01
2005/0193664 A1* 9/2005 Koenig et al. ..... 52/287.1
2005/0223657 A1* 10/2005 Brochu et al. ..... 52/94
2006/0053703 A1* 3/2006 Luttrell et al. ..... 52/94
2006/0075712 A1* 4/2006 Gilbert et al. ..... 52/520
2006/0196144 A1* 9/2006 Spek ..... 52/720.1
2006/0272237 A1* 12/2006 Koenig et al. ..... 52/211
2007/0062140 A1* 3/2007 Sillik ..... 52/404.1

* cited by examiner

PREFABRICATED DECORATIVE FRIEZE TRIM

BACKGROUND OF THE INVENTION

1. Field of the Invention

The present invention relates to a frieze trim, and more particularly, a prefabricated decorative frieze trim.

2. Description of the Prior Art

Numerous innovations for siding trim components have been provided in the prior art that will be described. Even though these innovations may be suitable for the specific individual purposes to which they address, however, they differ from the present invention.

A FIRST EXAMPLE, U.S. Pat. No. 5,090,174, Issued on Feb. 25, 1992, to Fragale teaches a siding trim piece which has a low gauge layer (preferably metal) of preferably about 0.013 gauge, with a substrate material (preferably foam) laminated to the low gauge layer. An edge of the siding trim piece preferably has an integral J channel. The substrate material is fixed to the structure preferably by an adhesive. A method for siding a structure includes the steps of covering the trim, edges and corners in a structure with the siding trim pieces having an integral J channel, and covering the exterior surfaces with siding by inserting ends of the siding into the J channels of the siding trim pieces to abut the siding with the trim, edges and corners of the structure without interposing a separate intermediate seam covering material between the siding, corners, edges and trim. The invention provides a wood-like appearance and avoids the appearance of discontinuities between the siding and trim, edges and corners of the structure.

A SECOND EXAMPLE, U.S. Pat. No. 5,537,791, Issued on Jul. 23, 1996, to Champagne teaches a mounting clip for siding. The clip has a first face and a second face. The clip is formed from a continuous metal strip having a first generally straight portion, a first U-bend portion, and a second U-bend portion. Each portion has a first face and a second face which correspond to the first face and the second face of the clip. Each portion has a first end and a second end. The second end of the first generally straight portion is attached to the first end of the first U-bend portion. The first U-bend portion bends toward the first face of the strip. The first end of the second U-bend portion is attached to the second end of the first U-bend portion. The second end of the second U-bend portion is positioned between the first end of the first U-bend portion and the first face of the first generally straight portion. The second U-bend portion forms an angle in the range of from about 120 degrees to about 150 degrees with respect to the first U-bend portion. The second end of the second U-bend portion forms at least one point which is oriented toward the first U-bend portion. The configuration is easy to insert into a trim strip by hand, and requires no special tools. When the clip is provided with at least one barb protruding from the first face of the first generally straight portion and pointing toward the second U-bend portion it provides more reliable attachment to the topout panel. Where each U-bend portion has a pair of legs which are positioned in generally parallel planes, application of the clip is eased. By providing the clip with a second generally straight portion having a first end and a second end and a bent portion connecting the first generally straight portion with the second generally straight portion the bent portion bending away from the first face of the first generally straight portion; wherein the second generally straight portion forms an angle in the range of from about 20 degrees to about 60 degrees with respect to the first generally straight portion the clip may be used to reliably position the topout panel in a trim strip have a relatively wide groove, due to the biasing action of the second straight portion.

A THIRD EXAMPLE, U.S. Pat. No. 5,598,677, Issued on Feb. 4, 1997, to Rehm, III teaches an insulated covering for building sheathing comprising foam insulation shaped to occupy the area between raised construction panels and the building sheathing and sized to leave narrow air-gaps, horizontally and vertically, between the outside surfaces of the foam insert and inside surfaces of the raised aspects of the construction panel. The panels are secured to the building in a manner that allows the foam insert to float, freely, within the raised panel. The inserts provide the panels with enhanced structural durability and improved insulating qualities. Allowing the insert to float freely within the raised panels prevents annoying noises and panel deformation caused when tight fitting foam insulation expands during rapid temperature changes and warm weather. A foam insert shaped to accommodate simulated shake roof aluminum roofing panels is illustrated.

A FOURTH EXAMPLE, U.S. Pat. No. 5,711,117, Issued on Jan. 27, 1998, to Zaccagni et al. teaches a generally vertical siding panel having an upper edge portion formed with at least two laterally spaced trim-engaging tabs and a generally horizontal soffit panel having a back edge portion are employed with a siding panel-trimming and soffit-anel mounting assembly comprising a supporting member and a retaining member. As extruded from a polymeric material, the supporting member has a generally vertical back panel and an upper front flange, which projects frontwardly from the back panel and overlies the back edge portion of the soffit panel. As extruded from a polymeric material, the retaining member is a separate member attached to the supporting member and has a lower front flange, which projects from the back panel and underlies the back edge portion of the soffit panel. One of the supporting and retaining members defines a hook behind the back panel. The hook interengages with the trim-engaging tabs, for trimming and mounting the upper edge portion of the siding panel so as to conceal the upper edge portion of the siding panel and the trim-engaging tabs behind the back panel. The back panel is offset so as to have an upper portion and a lower portion with the upper portion behind and above the lower portion. In a preferred embodiment, in which the supporting member defines the hook, the lower portion of the back panel defines a socket, which opens downwardly and receives a back edge portion of the retaining member. The socket and the back edge portion of the retaining member are shaped complementarily so as to enable the back edge portion thereof to be snap-fitted into the socket. In an alternative embodiment, in which the retaining member defines the hook, the lower portion of the back panel defines a channel, which opens upwardly and receives a back edge portion of the retaining member.

A FIFTH EXAMPLE, U.S. Pat. No. 5,829,206, Issued on Nov. 3, 1998, to Bachman teaches a system and method for assisting in finishing and securing a top panel for a wall to a J-channel of a soffit. The system includes a soffit panel covering a surface, a J-channel bracket from which the soffit is mounted into, a top panel snap-in trim, and a top panel. The top panel snap-in trim includes, at an end, a top snap-in trim grasper for interlocking with a hook at the end of the J-channel bracket. Additionally, the top panel snap-in trim includes, at another end, a top panel snap-in trim fastener for contacting the top panel to the wall. Wires or cables may be run through a gap between the top panel snap-in trim and a corner where the soffit panel and the top panel meet. Additionally, the top panel snap-in trim may also act as a trim sectional with coordinating colors to match and accentuate the beauty of the siding panels.

It is apparent now that numerous innovations for siding trim components have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a prefabricated decorative frieze trim that avoids the disadvantages of the prior art.

ANOTHER OBJECT of the present invention is to provide a prefabricated decorative frieze trim that is simple and inexpensive to manufacture.

STILL ANOTHER OBJECT of the present invention is to provide a prefabricated decorative frieze trim that is simple to use.

BRIEFLY STATED, STILL YET ANOTHER OBJECT of the present invention is to provide a prefabricated decorative frieze trim for securement to a lower surface of an eave and an exterior wall surface of a building which comprises a low gauge flexible sheet having a front face with an infinite variety of different ornamental shapes that can be formed thereon. A substrate member is applied to an internal surface of the low grade flexible sheet to provide structural rigidity thereto. A mechanism formed on the low grade flexible sheet is for securing the low grade flexible sheet to the lower surface of the eave and upper portion of the exterior wall surface of the building, whereby a free edge of a soffit component and a free edge of a wall siding can be retained thereto.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
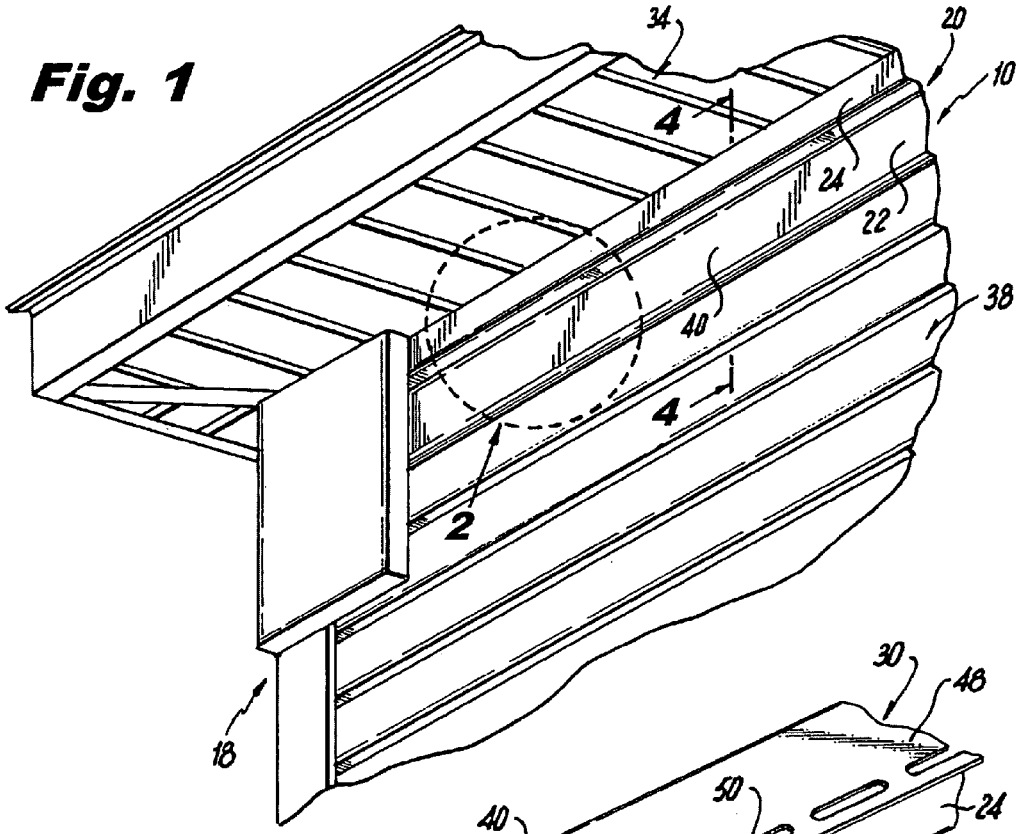
FIG. 1 is a diagrammatic perspective view illustrating an embodiment of the present invention installed on a portion of a building.
Figure 2:
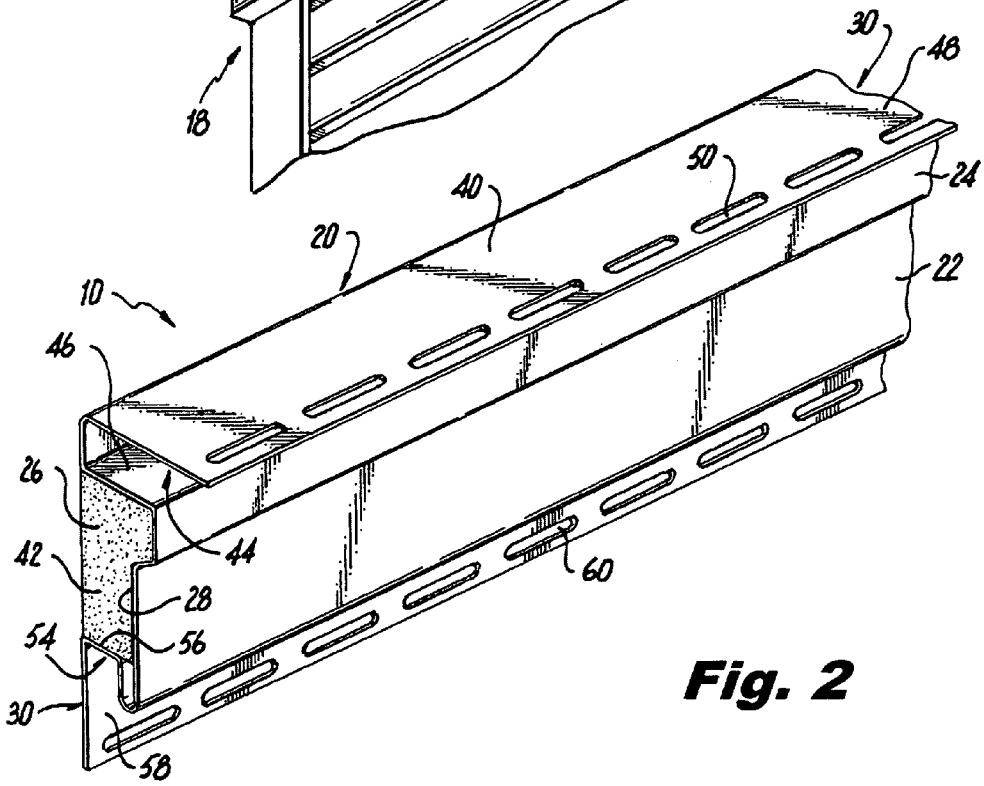
FIG. 2 is an enlarged diagrammatic perspective view per se, of the present invention shown in the area enclosed by the dotted circle indicated by arrow 2 in FIG. 1.
Figure 3:
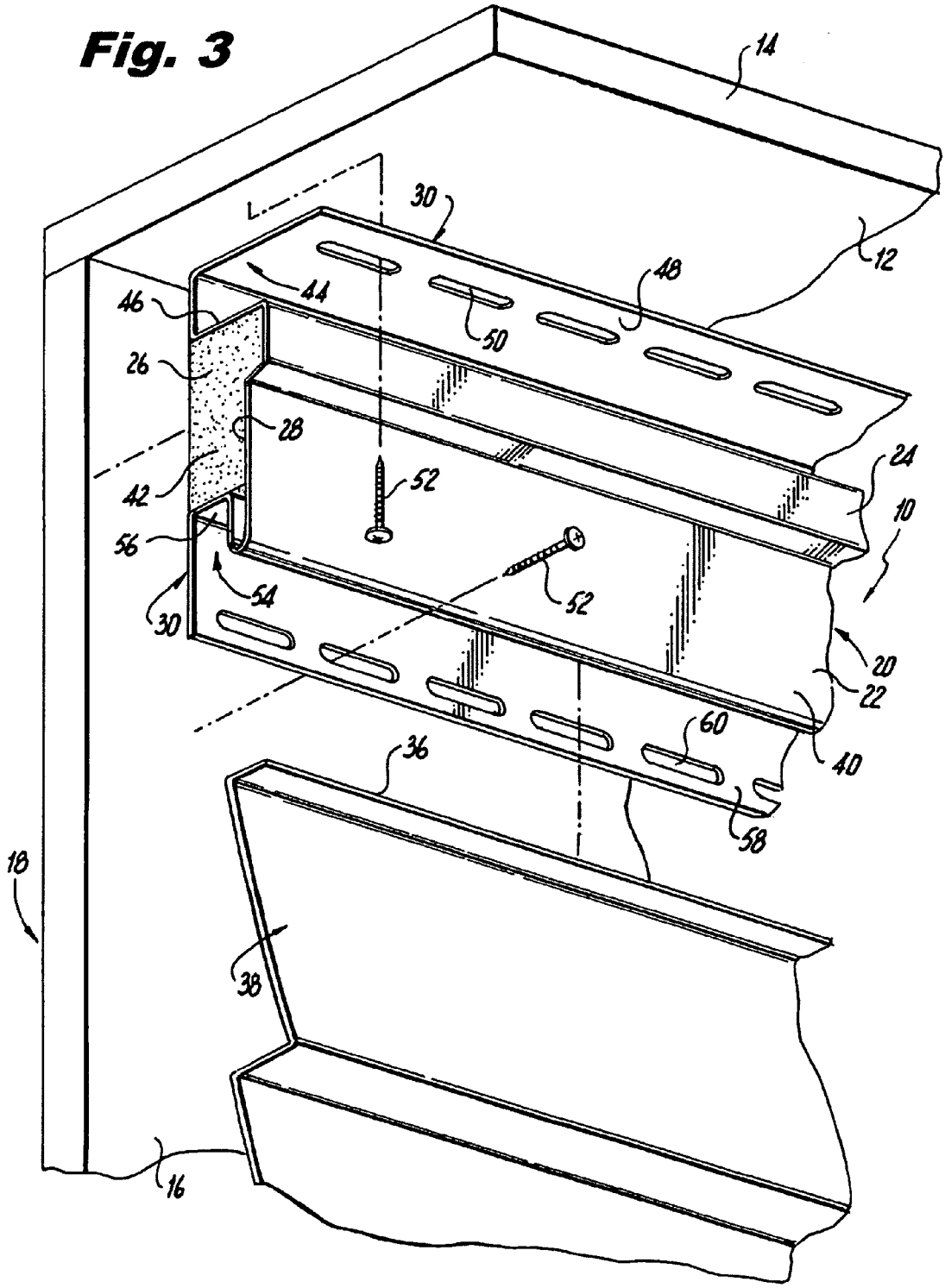
FIG. 3 is an enlarged exploded diagrammatic perspective view illustrating the present invention ready to be installed to an eave and exterior wall of the building.
Figure 4:
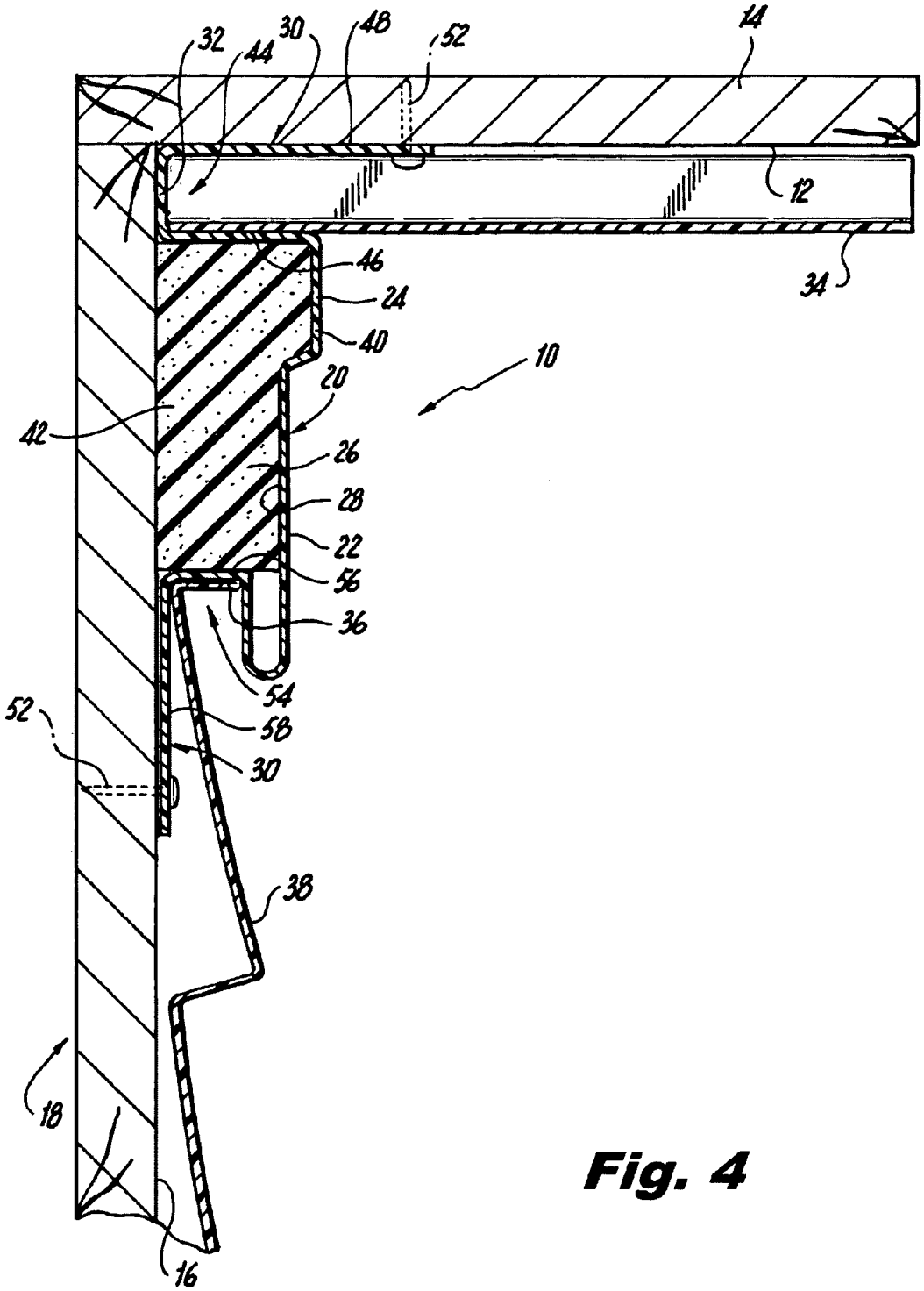
FIG. 4 is an enlarged diagrammatic cross sectional view, with parts broken away, taken on line 4-4 in FIG. 1.
Figure 5:
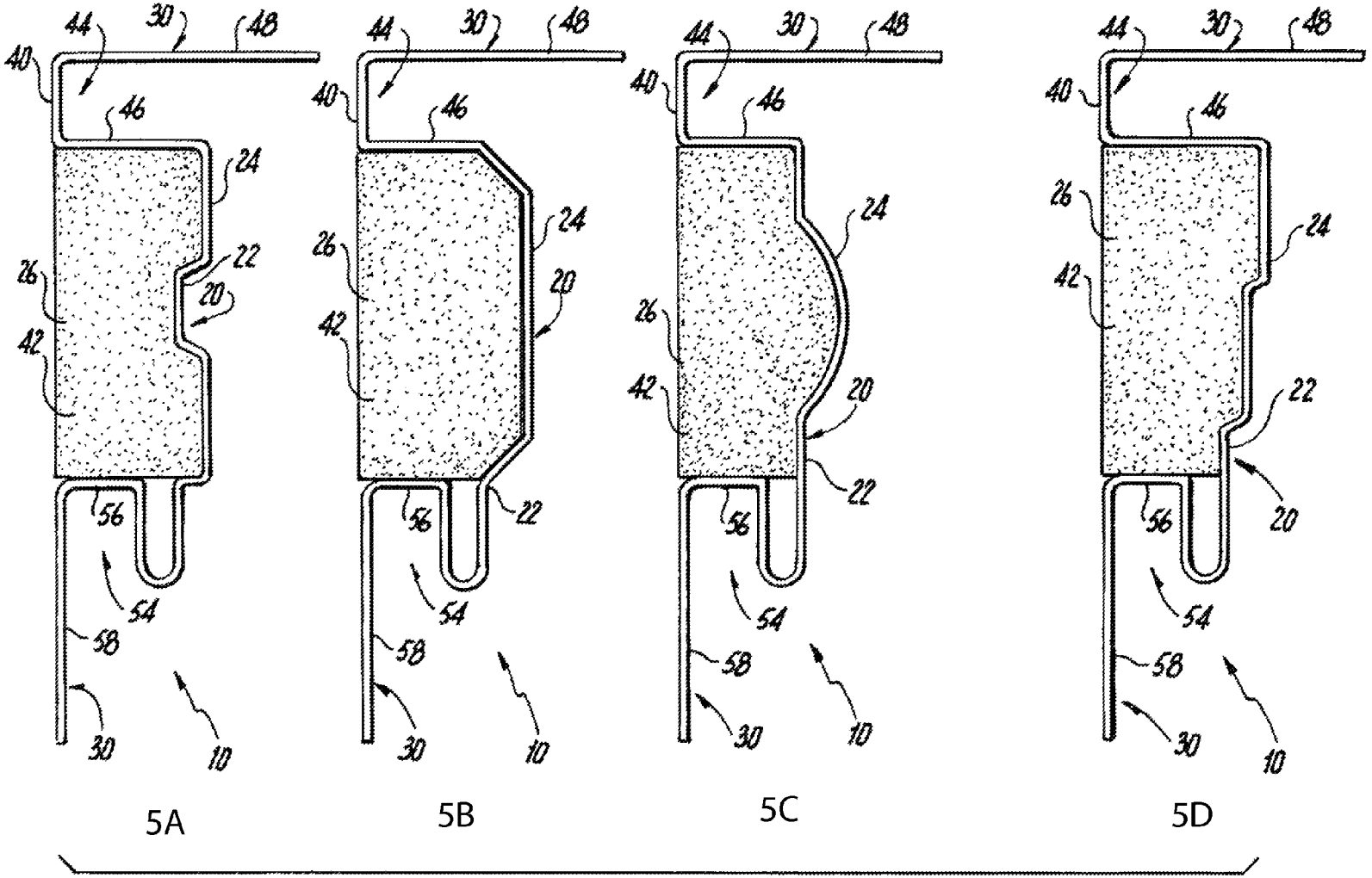
FIG. 5 is a diagrammatic end view illustrating examples of the present invention in which there are an infinite variety of ornamentation located on each front face thereof.

10 prefabricated decorative frieze trim
12 lower surface of eave 14
14 eave of building 18
16 exterior wall surface of building 18
18 building
20 low gauge flexible sheet of prefabricated decorative frieze trim 10
22 front face of low gauge flexible sheet
24 ornamented shape formed on front face 22
26 substrate member of prefabricated decorative frieze trim 10
28 internal surface of low gauge flexible sheet 20
30 securing mechanism of prefabricated decorative frieze trim 10
32 free edge of soffit component 34
34 soffit component
36 free edge of wall siding 38
38 wall siding
40 vinyl material for low gauge flexible sheet 20
42 stiff rigid foam material for substrate member 26
44 horizontal J-shaped channel on upper end 46
46 upper end of low gauge flexible sheet 20
48 long flange of horizontal J-shaped channel 44
50 slot in long flange 48
52 mounting screw
54 vertical J-shaped channel on lower end 56
56 lower end of low gauge flexible sheet 20
58 long flange of vertical J-shaped channel 54
60 slot in long flange 58

DETAILED DESCRIPTION OF THE PREFERRED EMBODIMENT

Referring now to the figures, in which like numerals indicate like parts, and particularly to FIGS. 1 through 4, which are a diagrammatic perspective view illustrating an embodiment of the present invention installed on a portion of a building; an enlarged diagrammatic perspective view per se, of the present invention shown in the area enclosed by the dotted circle indicated by arrow 2 in FIG. 1; an enlarged exploded diagrammatic perspective view illustrating the present invention ready to be installed to an eave and exterior wall of the building; an enlarged diagrammatic cross sectional view, with parts broken away, taken on line 4-4 in FIG. 1; and a diagrammatic end view illustrating a series of the present invention in which there are an infinite variety of ornamentation located on each front face thereof, and as such, will be discussed with reference thereto.

The present invention is a prefabricated decorative frieze trim 10 for securement to a lower surface 12 of an eave 14 and an exterior wall surface 16 of a building 18 which comprises a low gauge flexible sheet 20 having a front face 22 with an infinite variety of different ornamental shapes 24 that can be formed thereon. A substrate member 26 is applied to an internal surface 28 of the low grade flexible sheet 20 to provide structural rigidity thereto. A mechanism 30 formed on the low grade flexible sheet 20 is for securing the low grade flexible sheet 20 to the lower surface 12 of the eave 14 and upper portion of the exterior wall surface 16 of the building 18, whereby a free edge 32 of a soffit component 34 and a free edge 36 of a wall siding 38 can be retained thereto.

The low gauge flexible sheet 20 is fabricated out of a vinyl material 40. The substrate member 26 is fabricated out of a stiff rigid foam material 42 which is shaped to fill in the space behind the internal surface 28 of the low gauge flexible sheet 20.

The securing mechanism 30 comprises a horizontal J-shaped channel 44 formed on an upper end 46 of the low gauge flexible sheet 20. The horizontal J-shaped channel 44 has on its long flange 48 a plurality of spaced apart slots 50 therealong. A mounting screw 52 extending through each slot 50 will secure the long flange 48 of the horizontal J-shaped channel 44 to the lower surface 12 of the eave 14 of the building 18, while the horizontal J-shaped channel 44 will receive the free edge 32 of the soffit component 34 therein.

A vertical J-shaped channel 54 is formed on a lower end 56 of the low gauge flexible sheet 20. The vertical J-shaped channel 54 has on its long flange 58 a plurality of spaced apart slots 60 therealong. A mounting screw 52 extending through each slot 60 will secure the long flange 58 of the vertical J-shaped channel 54 to the exterior wall surface 16 of the building 18, while the vertical J-shaped channel 54 will receive the free edge 36 of the wall siding 38 therein.

It will be understood that each of the elements described above, or two or more together, may also find a useful application in other types of constructions differing from the types described above.

While the invention has been illustrated and described as embodiments of a prefabricated decorative frieze trim, accordingly it is not limited to the details shown, since it will be understood that various omissions, modification, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A prefabricated decorative frieze trim, comprising:

a) a sheet; and b) a backing block;

wherein said backing block backs up a major portion of said sheet, to thereby provide structural rigidity to said sheet;

wherein said sheet includes a first portion;

wherein said sheet includes a second portion;

wherein said sheet includes a third portion;

wherein said sheet includes a fourth portion;

wherein said sheet includes a fifth portion;

wherein said sheet includes a sixth portion;

wherein said sheet includes a seventh portion;

wherein said sheet includes an eighth portion;

wherein said first portion of said sheet, in side elevation, is straight;

wherein said first portion of said sheet, in side elevation, extends horizontally rearwardly from an origin to a first bend;

wherein said second portion of said sheet, in side elevation, is straight;

wherein said second portion of said sheet, in side elevation, extends vertically downwardly from said first bend of said sheet to a second bend;

wherein said second portion of said sheet, in side elevation, is perpendicular to said first portion of said sheet;

wherein said third portion of said sheet, in side elevation, is straight;

wherein said third portion of said sheet, in side elevation, extends horizontally forwardly from said second bend of said sheet to a third bend of said sheet;

wherein said third bend of said sheet, in side elevation, is more rearwardly than said origin of said first portion of said sheet;

wherein said third portion of said sheet, in side elevation, is below said first portion of said sheet;

wherein said third portion of said sheet, in side elevation, is parallel to said first portion of said sheet;

wherein said third portion of said sheet, in side elevation, is perpendicular to said second portion of said sheet;

wherein said fourth portion of said sheet, in side elevation, has a shape;

wherein said fourth portion of said sheet, in side elevation, extends vertically downwardly from said third bend of said sheet to a first termination of said fourth portion of said sheet;

wherein said fifth portion of said sheet, in side elevation, is straight;

wherein said fifth portion of said sheet, in side elevation, extends vertically downwardly from said first termination of said fourth portion of said sheet to a fourth bend of said sheet;

wherein said fifth portion of said sheet, in side elevation, is parallel to said second portion of said sheet;

wherein said fifth portion of said sheet, in side elevation, is completely forward of said second portion of said sheet;

wherein said fourth bend of said sheet, in side elevation, is semi-circular;

wherein said fourth bend of said sheet, in side elevation, opens upwardly;

wherein said fourth bend of said sheet, in side elevation, extends rearwardly to a second termination;

wherein said sixth portion of said sheet, in side elevation, is straight;

wherein said sixth portion of said sheet, in side elevation, extends vertically upwardly from said second termination of said fourth bend of said sheet to a fifth bend of said sheet;

wherein said sixth portion of said sheet, in side elevation, is parallel to said fifth portion of said sheet;

wherein said sixth portion of said sheet, in side elevation, is rearwardly spaced from said fifth portion of said sheet so as to form a depending channel;

wherein said sixth portion of said sheet, in side elevation, is of a same length as said fifth portion of said sheet;

wherein said sixth portion of said sheet, in side elevation, is parallel to said second portion of said sheet;

wherein said sixth portion of said sheet, in side elevation, is forwardly spaced from said second portion of said sheet;

wherein said depending channel of said sheet conceals an upper portion of said eighth portion of said sheet;

wherein said seventh portion of said sheet, in side elevation, is straight;

wherein said seventh portion of said sheet, in side elevation, extends horizontally rearwardly from said fifth bend of said sheet to a sixth bend of said sheet;

wherein said seventh portion of said sheet, in side elevation, is below said first portion of said sheet;

wherein said seventh portion of said sheet, in side elevation, is below said third portion of said sheet;

wherein said seventh portion of said sheet, in side elevation, is parallel to said first portion of said sheet;

wherein said seventh portion of said sheet, in side elevation, is parallel to said third portion of said sheet;

wherein said seventh portion of said sheet, in side elevation, is perpendicular to said sixth portion of said sheet;

wherein said eighth portion of said sheet, in side elevation, is straight;

wherein said eighth portion of said sheet, in side elevation, extends vertically downwardly from said sixth bend of said sheet;

wherein said eighth portion of said sheet, in side elevation, is perpendicular to said seventh portion of said sheet;

wherein said eighth portion of said sheet, in side elevation, is in line with said second portion of said sheet;

wherein said eighth portion of said sheet, in side elevation, is parallel to said fifth portion of said sheet;

wherein said eighth portion of said sheet, in side elevation, is parallel to said sixth portion of said sheet;

wherein said eighth portion of said sheet, in side elevation, is rearwardly spaced from said fifth portion of said sheet;

wherein said eighth portion of said sheet, in side elevation, is rearwardly spaced from said sixth portion of said sheet;

wherein said eighth portion of said sheet, in side elevation, extends lower than said fourth bend of said sheet;

wherein said backing block, in side elevation, extends downwardly from said third portion of said sheet to said seventh portion of said sheet;

wherein said backing block, in side elevation, extends rearwardly from said fourth portion of said sheet;

wherein said backing block, in side elevation, matches said shape of said fourth portion of said sheet; and wherein said backing block, in side elevation, leaves said depending channel of said sheet empty.

2. The trim of claim 1, wherein said sheet is a low gauge and flexible sheet made of a material selected from the group consisting of vinyl and metal.

3. The trim of claim 1, wherein said backing block is made of a rigid foam;

wherein said rigid foam of said backing block has an outwardly facing surface; and wherein said outwardly facing surface of said backing block is shaped to match that of said third portion of said sheet.

4. The trim of claim 1, wherein said first portion of said sheet has a plurality of spaced-apart mounting slots therealong; and wherein said eighth portion of said sheet has a plurality of spaced-apart mounting slots therealong.

5. A prefabricated decorative frieze trim, comprising:

a) a sheet;

b) a backing block; and c) a building;

wherein said backing block backs up a major portion of said sheet, to thereby provide structural rigidity to said sheet;

wherein said building has an eave;

wherein said eave of said building has a soffit;

wherein said building has siding;

wherein said sheet includes a first portion;

wherein said sheet includes a second portion;

wherein said sheet includes a third portion;

wherein said sheet includes a fourth portion;

wherein said sheet includes a fifth portion;

wherein said sheet includes a sixth portion;

wherein said sheet includes a seventh portion;

wherein said sheet includes an eighth portion;

wherein said first portion of said sheet, in side elevation, is straight;

wherein said first portion of said sheet, in side elevation, extends horizontally rearwardly from an origin to a first bend;

wherein said first portion of said sheet is attached to said eave of said building;

wherein said second portion of said sheet, in side elevation, is straight;

wherein said second portion of said sheet, in side elevation, extends vertically downwardly from said first bend of said sheet to a second bend;

wherein said second portion of said sheet, in side elevation, is perpendicular to said first portion of said sheet;

wherein said third portion of said sheet, in side elevation, is straight;

wherein said third portion of said sheet, in side elevation, extends horizontally forwardly from said second bend of said sheet to a third bend of said sheet;

wherein said third bend of said sheet, in side elevation, is more rearwardly than said origin of said first portion of said sheet;

wherein said third portion of said sheet, in side elevation, is below said first portion of said sheet;

wherein said third portion of said sheet, in side elevation, is parallel to said first portion of said sheet;

wherein said third portion of said sheet, in side elevation, is perpendicular to said second portion of said sheet;

wherein said first portion of said sheet, said second portion of said sheet, and said third portion of said sheet, in side elevation, forms a first channel;

wherein said first channel of said sheet, in side elevation, engages said soffit of said eave of said building;

wherein said fourth portion of said sheet, in side elevation, has a shape;

wherein said fourth portion of said sheet, in side elevation, extends vertically downwardly from said third bend of said sheet to a first termination of said fourth portion of said sheet;

wherein said fifth portion of said sheet, in side elevation, is straight;

wherein said fifth portion of said sheet, in side elevation, extends vertically downwardly from said first termination of said fourth portion of said sheet to a fourth bend of said sheet;

wherein said fifth portion of said sheet, in side elevation, is parallel to said second portion of said sheet;

wherein said fifth portion of said sheet, in side elevation, is completely forward of said second portion of said sheet;

wherein said fourth bend of said sheet, in side elevation, is semi-circular;

wherein said fourth bend of said sheet, in side elevation, opens upwardly;

wherein said fourth bend of said sheet, in side elevation, extends rearwardly to a second termination;

wherein said sixth portion of said sheet, in side elevation, is straight;

wherein said sixth portion of said sheet, in side elevation, extends vertically upwardly from said second termination of said fourth bend of said sheet to a fifth bend of said sheet;

wherein said sixth portion of said sheet, in side elevation, is parallel to said fifth portion of said sheet;

wherein said sixth portion of said sheet, in side elevation, is rearwardly spaced from said fifth portion of said sheet so as to form a depending channel;

wherein said sixth portion of said sheet, in side elevation, is of a same length as said fifth portion of said sheet;

wherein said sixth portion of said sheet, in side elevation, is parallel to said second portion of said sheet;

wherein said sixth portion of said sheet, in side elevation, is forwardly spaced from said second portion of said sheet;

wherein said depending channel of said sheet conceals an upper portion of said eighth portion of said sheet;

wherein said seventh portion of said sheet, in side elevation, is straight;

wherein said seventh portion of said sheet, in side elevation, extends horizontally rearwardly from said fifth bend of said sheet to a sixth bend of said sheet;

wherein said seventh portion of said sheet, in side elevation, is below said first portion of said sheet;

wherein said seventh portion of said sheet, in side elevation, is below said third portion of said sheet;

wherein said seventh portion of said sheet, in side elevation, is parallel to said first portion of said sheet;

wherein said seventh portion of said sheet, in side elevation, is parallel to said third portion of said sheet;

wherein said seventh portion of said sheet, in side elevation, is perpendicular to said sixth portion of said sheet;

wherein said eighth portion of said sheet, in side elevation, is straight;

wherein said eighth portion of said sheet, in side elevation, extends vertically downwardly from said sixth bend of said sheet;

wherein said eighth portion of said sheet, in side elevation, is perpendicular to said seventh portion of said sheet;

wherein said eighth portion of said sheet, in side elevation, is in line with said second portion of said sheet;

wherein said eighth portion of said sheet, in side elevation, is parallel to said fifth portion of said sheet;

wherein said eighth portion of said sheet, in side elevation, is parallel to said sixth portion of said sheet;

wherein said eighth portion of said sheet, in side elevation, is rearwardly spaced from said fifth portion of said sheet;

wherein said eighth portion of said sheet, in side elevation, is rearwardly spaced from said sixth portion of said sheet;

wherein said eighth portion of said sheet, in side elevation, extends lower than said fourth bend of said sheet;

wherein said eighth portion of said sheet is secured to the building;

wherein said sixth portion of said sheet, said seventh portion of said sheet, and said eighth portion of said sheet, in side elevation, form a second channel;

wherein said second channel of said sheet engages said siding of said building;

wherein said backing block, in side elevation, extends downwardly from said third portion of said sheet to said seventh portion of said sheet;

wherein said backing block, in side elevation, extends rearwardly from said fourth portion of said sheet;

wherein said backing block, in side elevation, matches said shape of said fourth portion of said sheet; and wherein said backing block, in side elevation, leaves said depending channel of said sheet empty.

6. The trim of claim 5, wherein said sheet is a low gauge and flexible sheet made of a material selected from the group consisting of vinyl and metal.

7. The trim of claim 5, wherein said backing block is made of a rigid foam;

wherein said rigid foam of said backing block has an outwardly facing surface; and wherein said outwardly facing surface of said backing block is shaped to match that of said third portion of said sheet.

8. The trim of claim 5, wherein said first portion of said sheet has a plurality of spaced-apart mounting slots therealong; and wherein said eighth portion of said sheet has a plurality of spaced-apart mounting slots therealong.

* * * * *